US005258743A

United States Patent [19]

Nelson et al.

[11] Patent Number: 5,258,743

[45] Date of Patent: Nov. 2, 1993

[54] PIEZOELECTRIC MOTION SENSOR

[75] Inventors: Jon Nelson, St. Paul, Minn.; William W. Williamson, Somerset, Wis.

[73] Assignee: Uniplex Corporation, St. Paul, Minn.

[21] Appl. No.: 789

[22] Filed: Jan. 4, 1993

Related U.S. Application Data

[63] Continuation of Ser. No. 722,202, Jul. 29, 1991.

[51] Int. Cl.[5] ..... G08B 13/14

[52] U.S. Cl. ..... 340/568; 310/330; 340/539; 340/566; 340/665; 340/666

[58] Field of Search ..... 340/568, 666, 665, 566, 340/539; 310/330

[56] References Cited

U.S. PATENT DOCUMENTS 3,588,858 6/1971 Demuth ..... 340/539

3,760,402 9/1973 Magerle et al. ..... 340/568

4,737,110 4/1988 Masuda ..... 434/350

5,004,999 4/1991 Hartmann et al. ..... 340/539

*Primary Examiner*—Glen R. Swann, III

*Attorney, Agent, or Firm*—Douglas L. Tschida

[57] ABSTRACT

A piezoelectric resilient arm contacts a projected object and establishes a reference relative to sensitivity means and differential detector means including feedback coupled amplifier means which operates in cooperation with a balanced square wave generator means for producing a switched output upon detecting motion. An alarm signal is produced which has a duration related to the rate of change of movement of the piezoelectric resilient arm. Programmable delay means appropriately enables an annunciator and/or wireless communication link to a system controller.

11 Claims, 6 Drawing Sheets

PIEZOELECTRIC MOTION SENSOR

This is a continuation of application Ser. No. 07/722,202, filed Jul. 29, 1991.

BACKGROUND OF THE INVENTION

The present invention relates to security alarm systems and, in particular, to a motion detector which finds advantage with normally immobile objects, such as art objects.

Museums, art galleries, collectors and the like are posed with the problem of creating displays which best present a collection, yet protect their collection from theft or tampering. This is oftentimes difficult to achieve without relatively sophisticated or customized security stations.

Hard wired installations can be established for wall, floor or ceiling mounted displays with varying degrees of effort and depending upon the availability of duct work or other conduits for storing and channelling the conductors. Greater flexibility is obtainable with a wireless installation, but heretofore sensors have not been available which accommodate wide varieties of installations. Rather, such installations tend to be customized and use special purpose sensors or sensors in combination with transmitters of relatively large dimension.

Of the latter types of installations, Applicant is aware of assemblies disclosed in U.S. Pat. Nos. 3,247,502 and 4,857,892. Particularly disclosed in these references are devices which protect art objects and sense motion relative to aligned magnets or distributed switch elements mounted within a surrounding framework and backing material. Such devices, however, do not readily find application with sculptural art works or centerpiece type mountings, where the art work is intended to be viewed from all sides.

Applicant is also aware of motion sensing assemblies including piezoelectric elements, such as within various glass breakage sensors. Descriptions of these later devices can be found upon directing attention to U.S. Pat. Nos. 3,863,250; 4,091,660; 4,307,387; 4,758,824 and 4,845,470. Depending upon the circuit construction, various of the foregoing devices detect glass movement relative to a threshold condition and annunciate the movement with an audible alarm. The devices do not provide delayed announcement nor a wireless communication link to a central controller. They are also not particularly sensitive to the rate of change of motion at the piezoelectric element, but rather only to the mere movement.

Another sensor circuit arrangement using piezoelectric elements can be found upon directing attention to U.S. Pat. No. 4,327,359, which discloses a balanced resistive bridge arrangement. U.S. Pat. No. 4,479,110 otherwise discloses a polarity independent detector which is coupled relative to delayed oscillator circuitry. Neither of the later circuits provide a wireless communications link nor are sensitive to the activity level of the piezoelectric elements.

In appreciation of the deficiencies of the art, Applicant has developed the present invention which provides a sensor adaptable to a variety of artwork mountings; which provides multiple annunciation options, either immediately or delayed; which is compatible with multiple communications links; and which is responsive to the activity level or rate of change of the physical sensor element.

SUMMARY OF THE INVENTION

It is accordingly a primary object of the present invention to provide a security alarm sensor having a relatively thin profile which is adaptable for use with wall mountings, such as paintings and centerpiece mountings, such as with sculptural works.

It is a further object of the invention to provide a sensor including a motion sensitive member which can be manipulated to a variety of mounting configurations.

It is a further object of the invention to provide a sensor circuit which provides a self-regulating detection threshold relative to ambient conditions and means for detecting the activity level of the sensor element or rate of change relative thereto.

It is a further object of the invention to provide a sensor including control circuitry which provides local annunciation and a programmable, delayed wireless communications link to a system controller.

Various of the foregoing objects, advantages and distinctions of the invention are particularly achieved in a preferred construction which provides a flat, planar sensor housing including a pivotally mounted flexible arm. The arm includes an artwork contact member coupled to a piezoelectric element. The arm is also rotatable and resiliently biased to contact works mounted to one side or upon the sensor housing.

The operating circuitry includes polarity independent, rate of change detection means which senses relative motion of the piezoelectric element, once a stable reference position is obtained for the support arm. Upon detection of movement in excess of a pre-set sensitivity threshold at an amplifier means, a resultant output is summed with the output of a balanced square wave generator means for further enabling switching means and an oscillator and local annunciator speaker.

Associated delay means sensitive to the activity level of the arm motion permits a programmable, delayed transmission of a detected alarm over a contained wireless transmitter means to an associated system controller.

Still other objects, advantages and distinctions of the invention, along with a detailed description will become more apparent from the following description with respect to the appended drawings. The appended description is illustrative only of the presently preferred construction and variously considered modifications and improvements thereto. It should not be interpreted in strict limitation of the invention, which instead should be interpreted from the spirit and scope of the following appended claims.

DESCRIPTION OF THE PREFERRED EMBODIMENT

Figure 1:
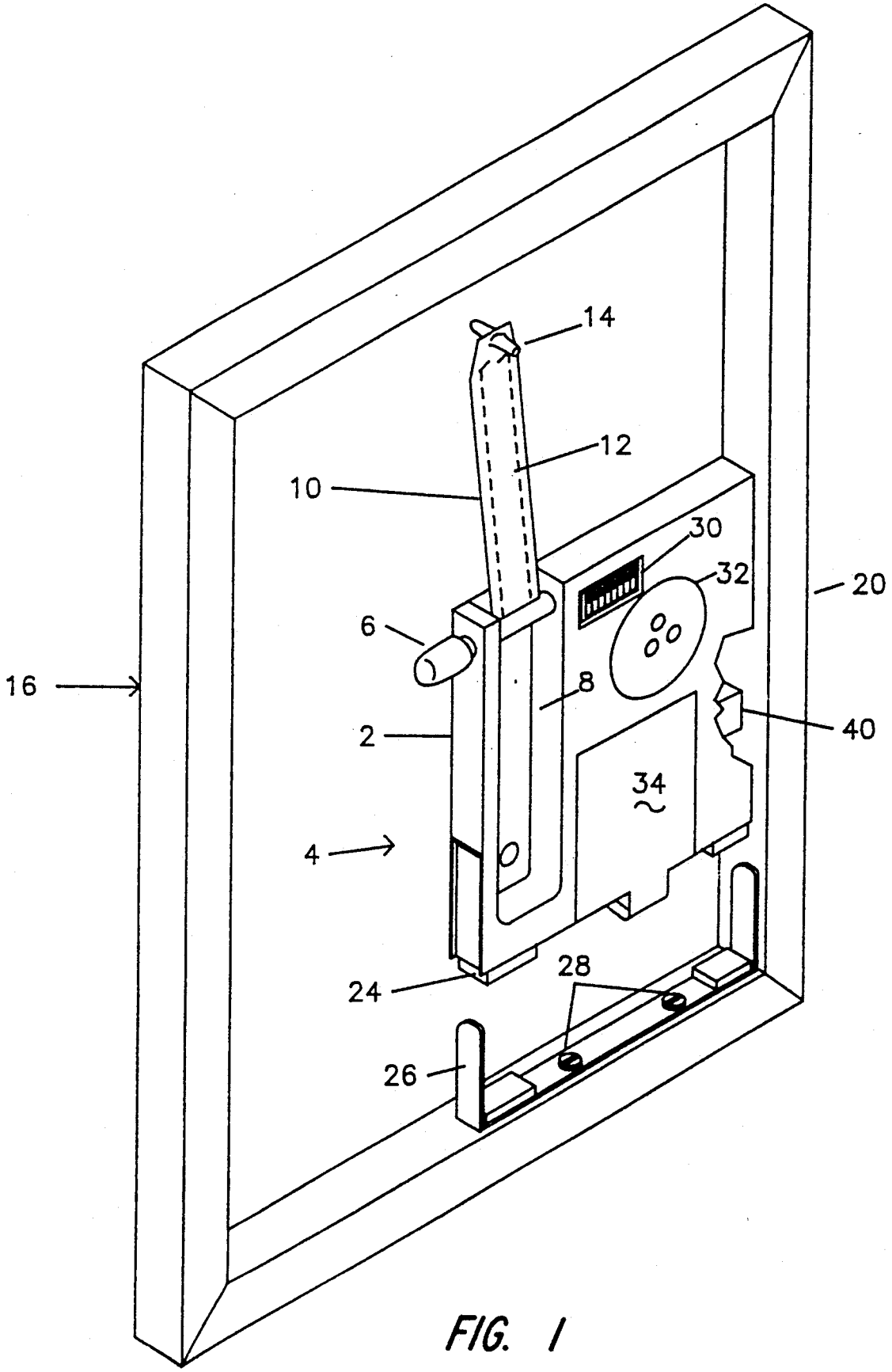
FIG. 1 shows an isometric drawing of the sensor housing and sensor arm in relation to a wall mounted painting.

Referring to FIG. 1, an isometric drawing is shown of the housing 2 which surrounds the sensor 4 of the subject invention. The housing 2 generally provides a relatively thin, flat panel configuration of nondescript form which is easily hidden. Preferably, the housing 2 is formed of a durable plastic which is sufficiently strong to support art works that might be directly placed thereon, such as in the mounting arrangement of FIG. 2.

Pivotally coupled at a pivot pin 6, which extends from the housing sidewall at a channelway 8 formed in the housing 2, is a flexible arm or sensor strip 10. Depending upon the sensor environment the strip 10 can be constructed from a variety of materials, such as metal or various plastics or laminations thereof. Presently, it is formed of stainless steel and is approximately $\frac{3}{4}$ inches wide by 3 inches long. Upon setting the tension of the pivot 6 and position of the strip 10, the strip 10 can be mounted in spring biased relation to a protected object.

Figure 4:
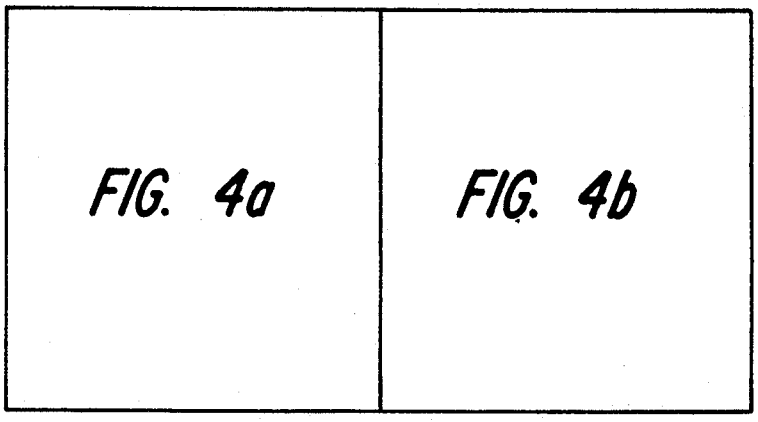
FIGS. 4, 4*a* and 4*b* show a detailed schematic diagram of the sensor circuitry.
Figure 4A:
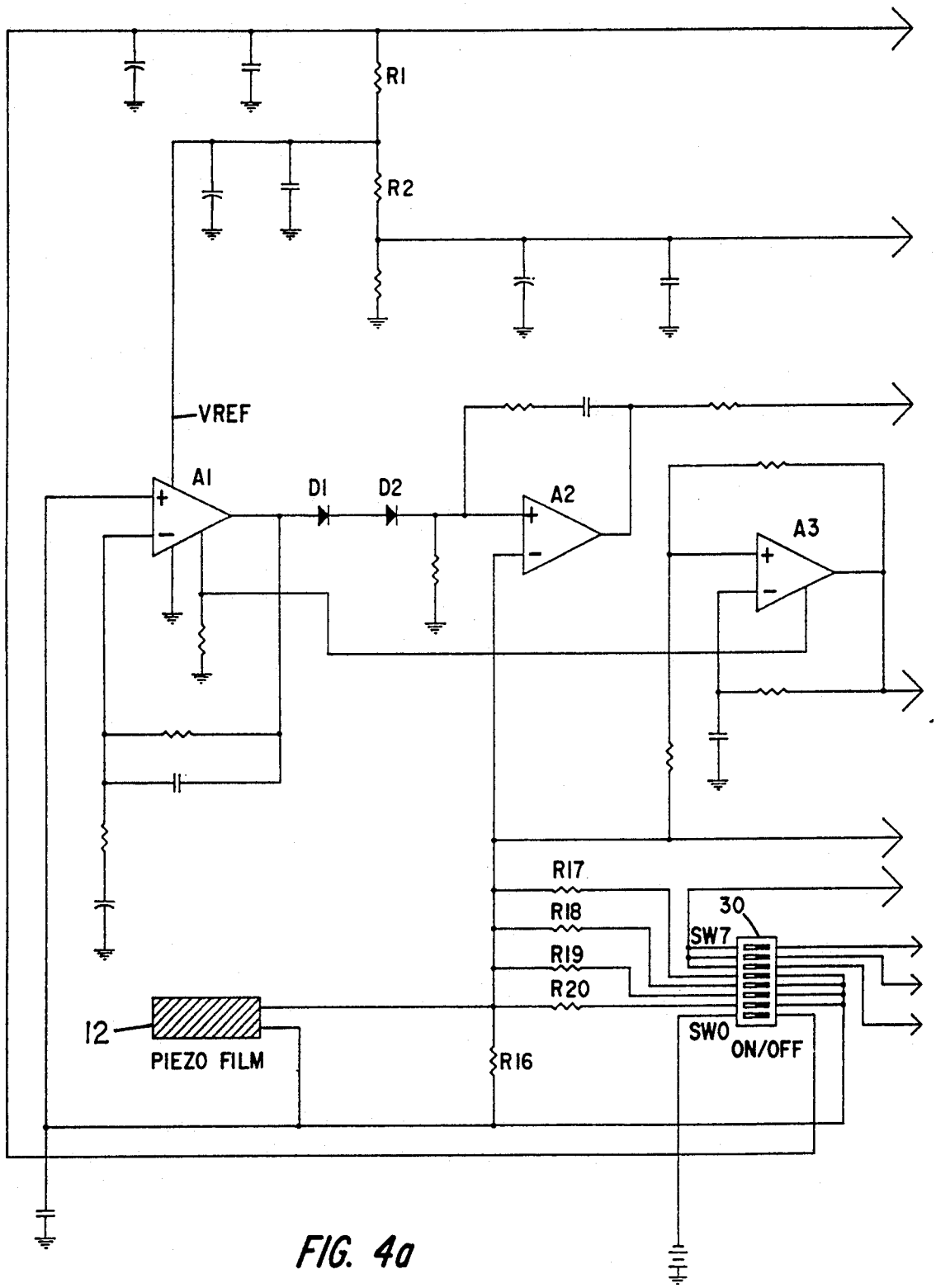
Figure 4B:
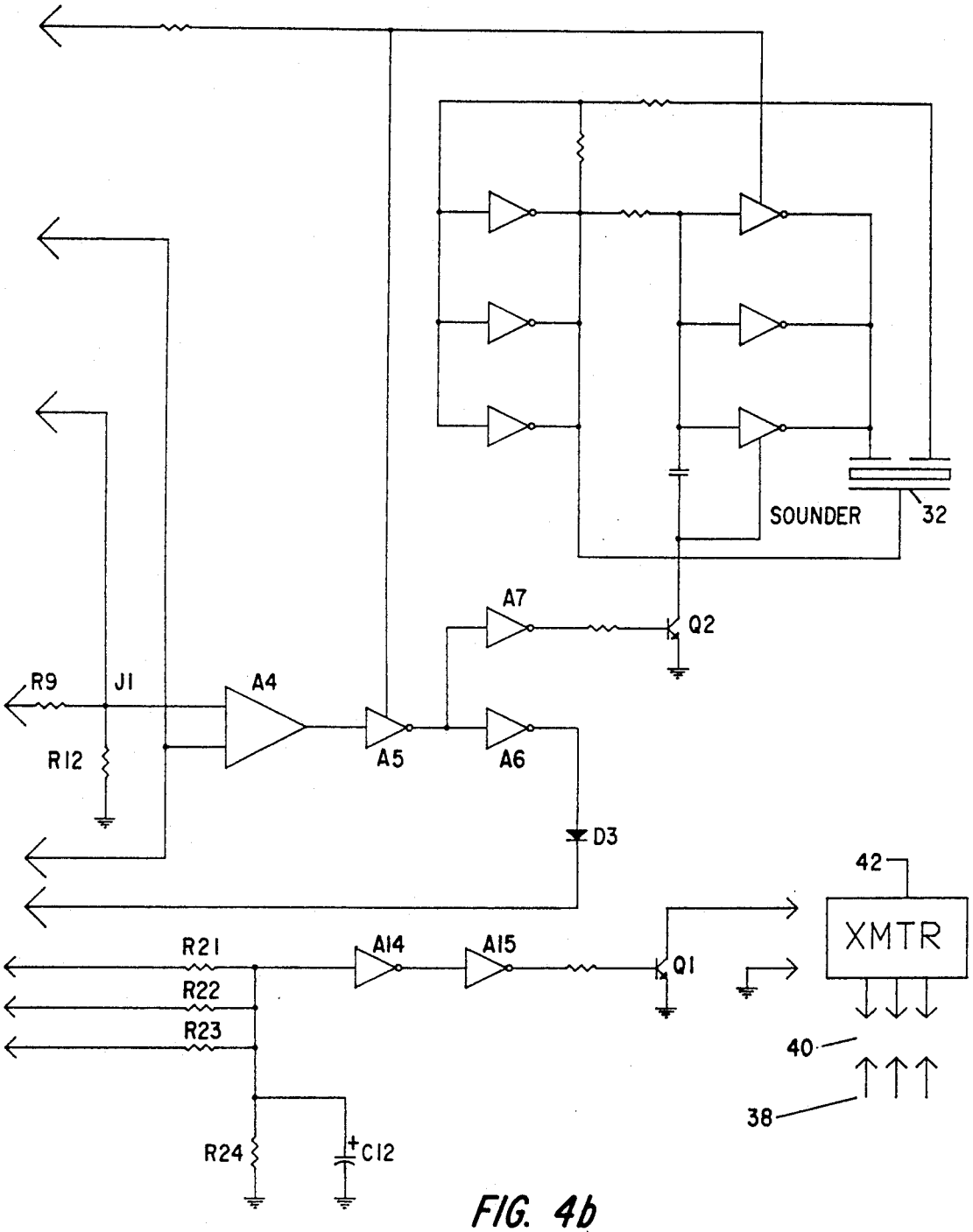

Laminated or adhesively bound to the strip 10 is a piezoelectric element or film 12, which is coupled to the circuitry of FIGS. 4, 4*a*, and 4*b*, and whereby strip motion is detectable via a voltage change. A projecting double ended contact member 14 mounts to the tip of the strip 10. In lieu of a single tip, a number of tips can be mounted along the strip 10. Alternatively, means, such as multiple holes, can be included for re-positioning the contact 14 along the strip 10.

Figure 2:
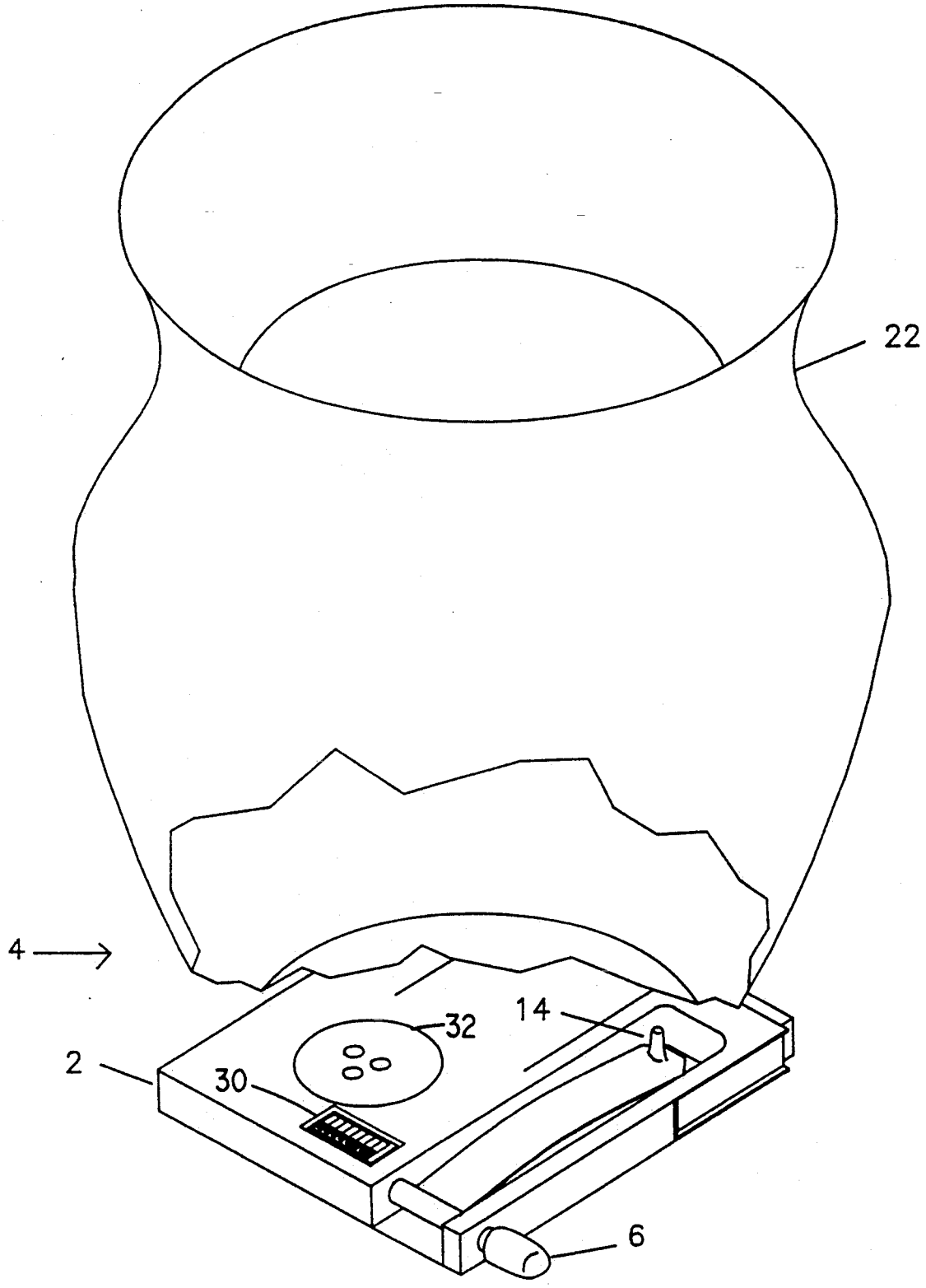
FIG. 2 shows an isometric drawing of the sensor in relation to a centerpiece mounted sculptural work.

Depending upon the system installation wherein the sensor 4 is to be mounted, the sensor strip 10 is appropriately rotated to properly position the tip 14 relative to a protected art work or the like. FIGS. 1 and 2 depict two alternative mountings. FIG. 1 particularly depicts the mounting of the sensor 4 in relation to the rear surface of a painting 16 and wherein the strip 10 is extended to contact the rear surface of the normally stationary canvas 18 and/or frame 20 which hangs from wall supports (not shown).

FIG. 2 shows an alternative mounting of the sensor housing 2 in relation to a sculptural work or vase 22 and wherein the sensor arm 10 is rotated into the channelway 8. In this position, the tip 14 resiliently contacts the underside of the vase 22, such that removal or movement of the vase 22 relative to the pedestal mounting is detectable. Due to the low profile nature of the housing 2, it is to be appreciated that the sensor 4 readily mounts within the frame 20 of most paintings and/or is obscured when mounted beneath a sculptural art work.

Useful for various mounting arrangements are a pair of magnetic latches 24 (reference FIG. 1) which are adhesively bonded to the housing sidewalls. The latches 24 are useful for engaging a metal formed mounting bracket 26. A length of double-sided tape or screw fasteners 28 secure the bracket 26 to the frame 20. Upon permanently mounting the bracket 26 to a rigid structure, the housing 2 may thus be removably secured thereto. For example in the arrangement of FIG. 1, the mounting bracket 26 is secured to the frame 20, although could be secured to the wall, such that the painting 16 and housing 2 are alignable with one another.

With continuing reference to FIG. 1, a plurality of micro switches 30 are shown which are mounted in recessed relation to the housing 2 and which are accessible by the installer to appropriately enable provided circuit functions. The switches particularly determine an on/off condition (SW0); programmably establish the sensitivity of the detection means (SW1–SW4); and determine a transmission delay for the transmitter (SW5–SW7), if an alarm is detected, or the transmission frequency of supervisory messages.

Mounted to one side of the switches 30 is an annunciator or speaker 32. A hinged cover 34 and internal cavity positioned below the cover 34 contains a number of batteries (not shown) which supply power to the on-board circuitry.

Otherwise with reference the cutaway portion of FIG. 1 and also to FIG. 4*b*, extending from the sidewall of the housing 2 is a multi-conductor programming cable 38 which couples between a contained programming socket 40 and a portable installer programmer (not shown). Depending upon the system, identification data, defining the sensor and system identity, along with operating parameters of the sensor 4, such as supervisory transmissions, may be programmed by the remote programmer into a wireless transmitter 42. Examples of such a programmer, transmitter and preconditioning parameters can be found upon directing attention to U.S. Pat. No. 4,737,770.

Before describing the details of the sensor circuitry, it is to be appreciated that although the housing 2 is depicted in a square construction, a variety of other housing configurations can be utilized. The various mounting positions and arrangements of the associated components, such as the pivot 6, channelway 8, etc., may also be suitably adjusted as necessary. Moreover, it is to be understood that the provided switches 30 and programmer cable 38 and connector 40 are representative of merely one form of programming arrangement. Alternatively a duplexed wireless programming communication link via the transmitter 42 could be used in relation to an installer programmed microprocessor accessed memory. The memory might also be factory programmed or programmed from the controller.

Figure 3:
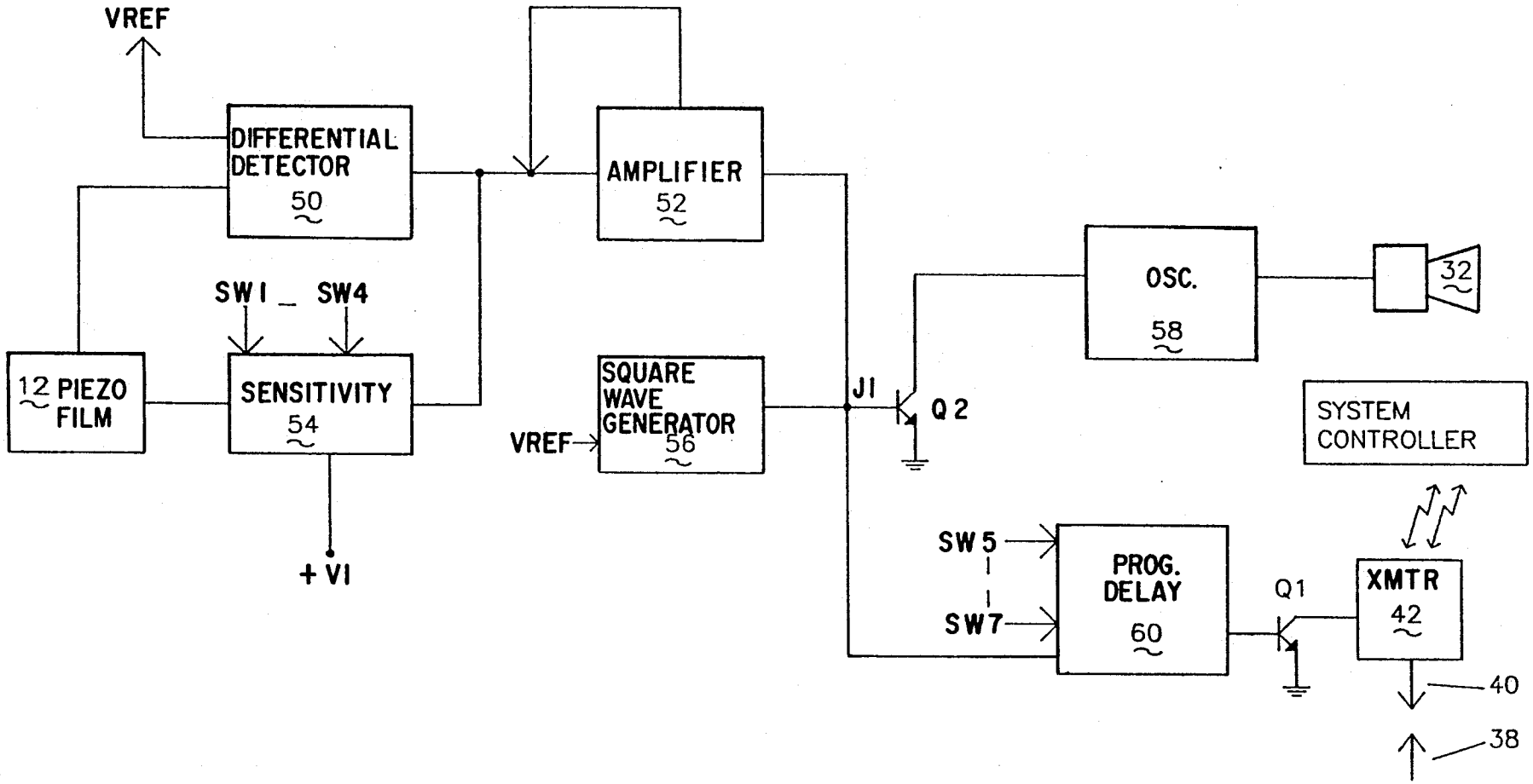
FIG. 3 shows a functional block diagram of the circuitry of the invention.

Turning attention to FIG. 3, a functional block diagram is shown of the circuitry contained within the housing. FIGS. 4, 4*a* and 4*b*, in turn, show a detailed schematic diagram of the circuitry. The latter circuitry will not be described in detail but rather will be referenced as appropriate in relation to the description of FIG. 3.

FIG. 3 otherwise particularly discloses the functional organization of the sensor circuitry which generally detects the rate of change of an input voltage from the piezoelectric film 12 at a differential detector means 50, which includes operational amplifier A1 and which is biased to a threshold or reference voltage Vref, typically 3 volts. Upon detecting a change in voltage at the input from the piezoelectric film 12, the operational amplifier A1 conducts to produce a proportional output which is coupled to a second feedback coupled amplifier means 52, which includes operational amplifier A2.

The sensitivity of the film 12 to movement is determined by the sensitivity means 54. Specifically, shunt resistor R16 in combination with selected ones of the resistors R17–R20 establish the sensitivity of the amplifier A2 to changes in the signal from amplifier A1. Switches SW1 to SW4 determine which resistors are selected. Diodes D1 and D2 filter transient, low level signals produced by the amplifier A1, such as might occur with sensed air movement or other ambient non-alarm motion detected at the contact tip 14. Thus, until a minimum change takes place in the signal from film 12, the amplifier A2 does not conduct. Once however the amplifier A2 conducts, its output is summed at the summing junction J1 with the output of a square wave generator means 56, which includes operational amplifier A3.

The output of the amplifier A2 is also feedback coupled to its input, which causes the input to stay positive for a period of time. The amount of time it stays positive is related to the amplitude of the input signal from amplifier A1, typical times are on the order of 0.5 to 2 seconds. Thus, a positive voltage level of variable duration is added to the output from the square wave generator 56 to produce a movement signal, which enables operational amplifier A4 to conduct at a corresponding pulse rate when the amplitude of the combined signals exceeds Vref.

The square wave generator means 56 comprises operational amplifier A3 which is coupled as a free running voltage vibrator that runs at approximately a 0.1 second rate. A full square wave is produced at the output of the generator 56 at approximately 10 pulses per second. The amplitude of the square wave output is approximately one half of the supply voltage as seen across the voltage divider comprised of resistors R9 and R12. When the output of amplifier A2 goes positive, it is added to the pedestal provided by the square wave generator 56 up to a level where operational amplifier A4 will conduct. In other words, in order for amplifier A4 to conduct it needs the positive pedestal from the sensor activation and amplifier A2 in addition to the square wave from the free running multi-vibrator of amplifier A3. The sum of the voltages being sufficient to cause the output of amplifier A4, which normally responds by switching from a logic low to a high condition.

Once the amplifier A4 conducts, the amplitude of the resultant pulsed signal or alarm signal is such as to cause switching transistors Q1 and/or Q2 to conduct and respectively enable the transmitter 42 or a 2700 hertz oscillator 58 which is coupled to the annuciator or piezoelectric sounder 32 contained within the housing 2. The annuciator 32 produces a corresponding pulsed output in relation to the summed input. Although a pulsed output is preferably produced, it is to be appreciated that the sounder 32 may continuously annunciate the alarm.

In lieu of providing an audible alarm annunciation or in combination therewith, the detected alarm output from the summing junction J1 is coupled to a programmable delay network 60 and a switching transistor Q1 which enables after a selectably delay the transmitter 42. The particular delay is determined by which of the resistors R21 to R23 are selected by switches SW5 to SW7 and shunted with resistor R24 and capaciter C12 to establish an appropriate time delay constant.

As mentioned, the time delay can also be totally disabled. Generally though a delay is desirable to prevent the notification of false alarms to a central station (not shown) in communication with the transmitter and also to enable on site security personnel to confirm a difficulty, prior to notifying the system controller.

More particularly, the modified square wave output at junction J1, which corresponds to how vigorous the piezoelectric strip 10 was activated, is passed through squaring inverters A5 and A6 and diode D3 to the switches SW5 to SW7. The switches determine the time constant of the RC network comprised of resistors R21 to R24 with capacitor C12. The correspondingly delayed voltage via inverters A14 and A15 activates pull down transistor Q1 and the output of which activates the radio transmitter 42. Thus, switches SW1 to SW7 control how vigorously the piezoelectric element 12 must be activated and how long before an output activates the transmitter 42.

While the present invention has been described with respect to its presently preferred construction and various modifications and improvements thereto, it is to appreciated that still other variations might suggest themselves to those of skill in the art. Accordingly, it is contemplated that the following claims should be interpreted to include all those equivalent embodiments within the spirit and scope thereof.

What is claimed is:

1. Motion detection apparatus comprising:

a) detection means including a piezoelectric sensor for detecting movement of an object, wherein said piezoelectric sensor is mounted in resilient contact with the object and wherein a movement signal is produced in response to movement of the piezoelectic sensor;

b) means for comparing the movement signal to a threshold signal corresponding to a stationary condition of said object;

c) means for producing an alarm signal, when said movement signal exceeds said threshold signal, wherein the alarm signal has a duration related to a detected rate of change of movement of the piezoelectric sensor; and d) means responsive to said alarm signal for annunciating detected movement.

2. Apparatus as set forth in claim 1 including:

a) wireless transmitter means responsive to said alarm signal; and b) means coupled to said wireless transmitter means for providing a plurality of selectable periods of delay, whereby transmissions from said transmitter means are delayed a predetermined amount of time after an alarm signal.

3. Apparatus as set forth in claim 2 including means for programming said transmitter means with a plurality of preconditioning parameters, including identification data identifying the detection apparatus to a system controller.

4. Apparatus as set forth in claim 1 wherein said piezoelectric sensor comprises a flexible strip including a tip portion and means for spring biasing the tip portion into contact with the object.

5. Apparatus as set forth in claim 4 including means for pivotally coupling said strip to a housing such that said tip portion may be rotatively positioned to contact the object.

6. Apparatus as set forth in claim 3 wherein the housing is substantially planar, wherein said strip is rotatable along an axis within the plane of the housing and wherein said housing includes a channelway wherein said strip is received in a first mounting position and from which channelway said strip may be rotated to a second mounting position such that said object may rest on said housing in said first mounting position and said strip may be rotated into contact with a displaced stationary object in said second position.

7. Apparatus as set forth in claim 1 including means for selectively establishing the sensitivity of said piezoelectric sensor to rates of change in movement.

8. Apparatus as set forth in claim 1 wherein said detection means includes means for producing a first signal of variable duration and means for summing the first signal with a second having a constant pulse width to produce said movement signal.

9. Motion detection apparatus comprising:

a) movement sensor means including a piezoelectric sensor for detecting movement of an object, wherein said piezoelectric sensor is mounted in resilient contact with the object, wherein a first signal of variable duration is produced with movement of said piezoelectric sensor, wherein the duration of the first signal indicates a rate of change of sensor movement, and wherein the first signal is summed with a second, constant width pulse signal to produce a movement signal;

b) means for selectively establishing the apparatus sensitivity to said piezoelectric sensor;

c) means for comparing the movement signal to a threshold signal corresponding to a stationary condition of said object;

d) means for producing an alarm signal, when said movement signal exceeds said threshold signal, having a variable duration related to the rate of change of movement of the piezoelectric sensor;

e) annunciator means responsive to said alarm signal for audibly selectively indicating detected movement;

f) wireless transmitter means; and g) switch means coupled to said transmitter means for providing a plurality of selectable periods of delay, whereby transmissions from said transmitter means are delayed a predetermined amount of time after movement is detected.

10. Apparatus as set forth in claim 8 wherein said piezoelectric sensor comprises a flexible strip including a tip portion and means for spring biasing the tip portion with the object.

11. Apparatus as set forth in claim 10 wherein said strip is pivotally coupled to a substantially planar housing and rotatable along an axis within the plane of the housing and wherein said housing includes a channelway wherein said strip is received in a first mounting position and from which channelway said strip may be rotated to a second mounting position such that said object may rest on said housing in said first mounting position and said strip may be rotated into contact with a displaced object in said second position.

* * * * *